United States Patent [19]

Podgorski et al.

[11] 4,240,666

[45] Dec. 23, 1980

[54] DEVICE FOR MINING OF THICK STRATA OF USEFUL MINERALS

[75] Inventors: Wojciech Podgórski, Bytom; Justyn Staś, Ruda Slaska, both of Poland

[73] Assignee: Centralny Osrodek Projektowokonstrukcyjny Maszyn Gorniczych "Komag", Gliwice, Poland

[21] Appl. No.: 22,264

[22] Filed: Mar. 20, 1979

[30] Foreign Application Priority Data

Apr. 14, 1979 [PL] Poland ..... 206086

[51] Int. Cl.[3] ..... E21C 27/34

[52] U.S. Cl. ..... 299/31; 299/32; 299/33

[58] Field of Search ..... 299/32–34

[56] References Cited

U.S. PATENT DOCUMENTS

| | | | |
|---|---|---|---|
| 3,419,312 | 12/1968 | Dommann | 299/32 |
| 3,847,438 | 11/1974 | Huttenbrauck et al. | 299/32 |

FOREIGN PATENT DOCUMENTS

| | | | |
|---|---|---|---|
| 2023612 | 5/1970 | Fed. Rep. of Germany | 299/32 |
| 95130 | 5/1975 | Poland . | |
| 373411 | 3/1973 | U.S.S.R. | 299/32 |
| 523170 | 7/1976 | U.S.S.R. | 299/32 |

*Primary Examiner*—Ernest R. Purser

*Attorney, Agent, or Firm*—Haseltine, Lake & Waters

[57] ABSTRACT

A device for mining thick coal strata comprising a plough pressed in the region of the floor by a ram, whereas in the vicinity of the roof the plough is pressed by a unit fixed to a canopy of the lining. The unit is provided with guides on which the plough is supported through a slide. A lever of a distributor is deflected by the plough and causes the unit to extend by an amount equal to the web of the plough.

7 Claims, 6 Drawing Figures

DEVICE FOR MINING OF THICK STRATA OF USEFUL MINERALS

FIELD OF THE INVENTION

The invention relates to a device for the mining of thick strata of useful minerals, consisting of a wall lining section, a mining machine (in particular, a coal plough), and a conveyor unit for the haulage of the winnings, in particular a scraper conveyor.

PRIOR ART

From Polish patent specification No. 95130 there is known a device comprising a wall plough designed for mining thick strata. The known device comprises: a mining roof support unit, a coal plough, and a conveyor. The coal plough is mounted slidably on a conveyor and is advanced along the longwall face by means of a chain extending along the conveyor. At the same time the coal plough is pressed against the body of coal indirectly by means of the conveyor on which it is advanced. The conveyor is pressed against the body of coal by means of a hydraulic ram, one end of which is supported on a floor beam of the wall lining, while the other end is fixed to the conveyor. In order to provide uniform pressure of the plough through its height, its entire upper part is pressed against the longwall face by means of a ram situated in parallel to the floor and fixed on a cantilever mounted the lining. The other end of the ram is supported to props mounted slidably in a direction perpendicular to the longwall face.

Drawbacks of the known device consist in its large dimensions which impede and—at a certain height of linings—make it impossible for personnel to pass by. The device is suitable only for the application in linings of a prop type. Permanent pressure from the upper ram may disturb operation of the coal plough in the case of instability in the longwall body. Moreover, in the conventional construction the props are loaded with disadvantageous overturning forces.

SUMMARY OF THE INVENTION

An object of the invention is to provide a device wherein the plough is pressed against the longwall face at one point in the vicinity of the floor and at another point above the floor at a level above the application point of the resultant force of the reaction of the mineral against the plough, the lining serving for transmitting the holding down forces of the plough at two different points.

This object has been achieved by a device comprising a roof support unit, a coal plough, and a winning haulage unit, in particular a scraper conveyor. The device is provided with two hydraulic rams parallel to each other, the upper ram being of a step-type advance equal to the web of the plough. The lower ram is fixed to the lining in the vicinity of the floor and acts, through the conveyor, upon the plough in a region close to the floor. The upper ram is fixed to the canopy of the lining. It acts upon the plough through a series of segments of tubular sections, on which a slide fixed to the plough advances. Such construction makes it possible to install a second, upper drive of the plough by to employing an additional guiding segment of the return run of the drive chain and by changing the slide system.

The device according to the invention presses the plough against the coal body at two points on opposite sides of the application point of the resultant of reaction forces of the mineral upon the plough, which provides uniform mining of the mineral and makes the plough more stable in the vertical plane. An advantage of the device, as compared to the known devices of this type, is that it can be installed in any type of lining and provides for easy passage of personnel along the heading. Moreover, due to the use of a ram of step-type advance, situated in the upper guiding section of the plough, the device provides for uniform pressure against the longwall face, in spite of possible instability in the mineral body. Furthermore, the application of upper and lower drives improves the operation of the plough.

DETAILED DESCRIPTION

Figure 1:
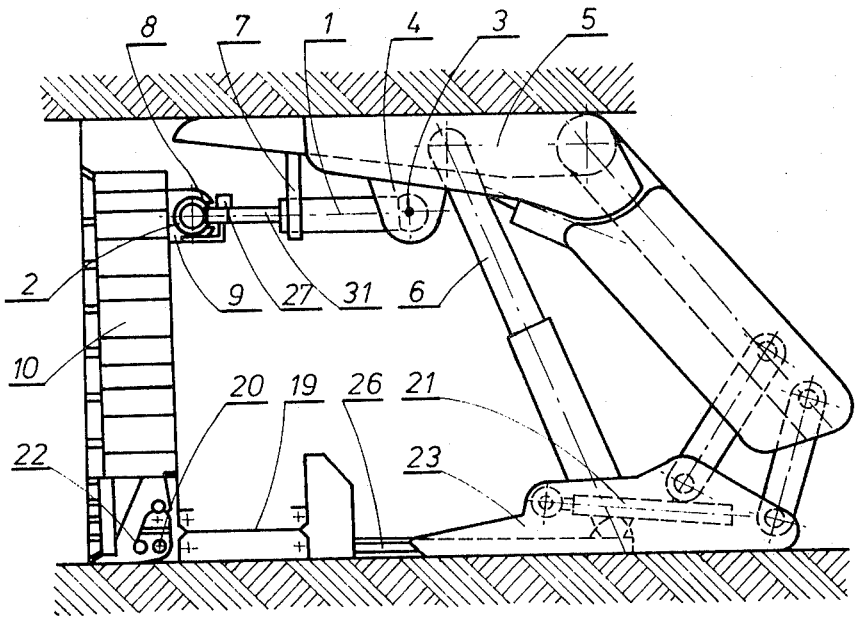
FIG. 1 is a side view of the device according to the invention.
Figure 2:
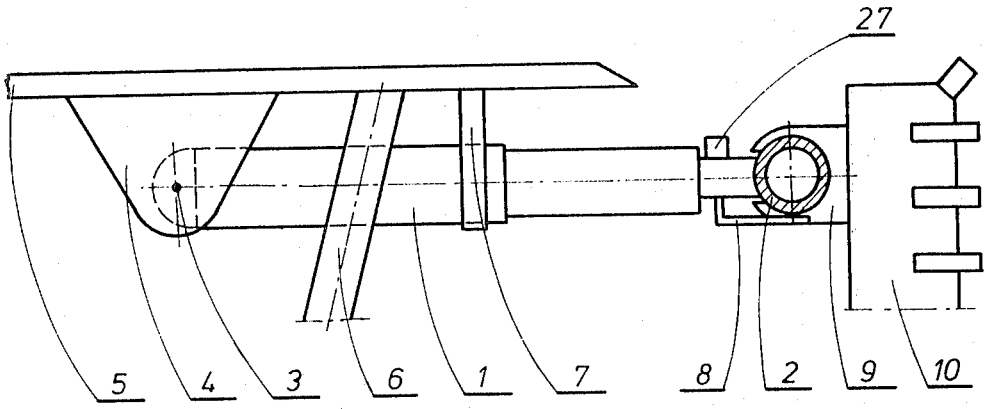
FIG. 2 shows a portion of FIG. 1 comprising the upper guide of the plough.
Figure 3:
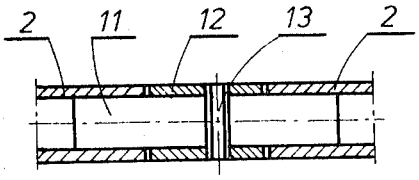
FIG. 3 shows the connection of the segments of the upper guide of the plough together with its upper drive.
Figure 4:
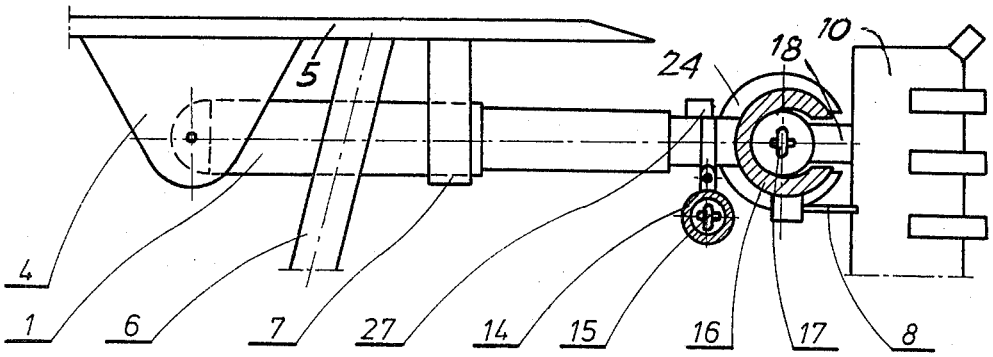
FIG. 4 shows a modified upper guide.
Figure 5:
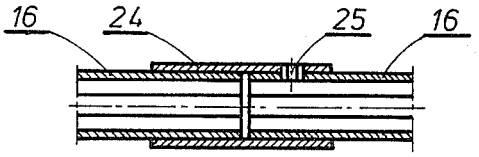
FIG. 5 shows a longitudinal section of the connection of segments of the upper guide of FIG. 4 with the drive.

To floor beam 23 of lining 6 there is fixed a lower pressure unit extending parallel to the floor, said unit consisting of lower ram 21 and slidable system 26 supported at its other end on a conveyor 19. An upper pressure unit 1 comprises a hydraulic ram of step-type advance, a single step being equal to the web of plough 10. The upper pressure unit is also situated parallel to the floor and is fixed by means of articulated joint 3 to cantilever 4 which is rigidly fixed to canopy 5 of lining 6.

The upper pressure unit 1 is mounted in clamping ring 7 fixed to canopy 5. The other end of the upper pressure unit is fixed to a segment of guide 2 on which slide 9 advances. The slide 9 is mounted on plough 10, slidably in a plane perpendicular to the floor. Segments of guide 2 form a series along conveyor 19. Particular segments of guide 2 are connected with one another by means of couplings fitted loosely in segments of guide 2. A coupling consists of pin 11 fitted in the segment of guide 2, and of sleeve 12 coupled with pin 11 by means of stud 13. The upper pressure unit comprises lever 8 of hydraulic distributor 27 controlling the upper pressure unit 1. This distributor serves for supplying the upper pressure unit 1 of another section which may be either a neighboring section or a more distant section in relation to a selected diagram of withdrawing sequence of the sections of lining 6.

In the case of employing an additional chain 17 with its return run 15 for driving plough 10, a segment 16 of the upper guide of plough 10 is fixed to a piston rod of the upper pressure unit 1.

Segments 16 are connected by means of outer sleeves 24 and connecting members 25. Segment 16 and sleeve 24 are provided with longitudinal recesses in which slide 18 is situated, said slide being fitted in segment 16. Chain 17 is fixed to slide 18. Return run 15 of chain 17 is supported to tube 14 fixed to the piston rod of the unit 1.

Figure 6:
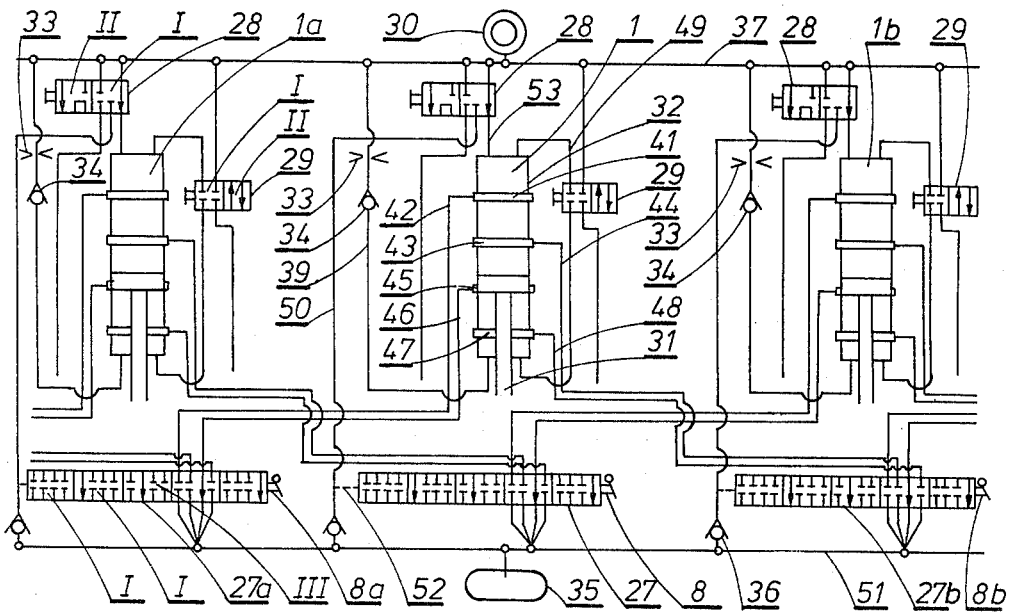
FIG. 6 shows a diagram of hydraulic drive of the device.

The upper pressure unit 1 is started by means of lever 8 operating distributor 27 included in the hydraulic drive of the system. The said system comprises a supply source 30 from which a hydraulic medium flows out under pressure to supply main 37. Supply main 37 is connected with units 1, 1*a* and 1*b* mounted in succeeding sections of the mining lining. On the other side of units 1, 1*a* and 1*b* there is a flow-off main 51 connected with tank 35. Movement of the upper pressure unit 1 fixed according to FIG. 6 to the central section of the lining is controlled by means of distributors 28, 29, 27*a* and 27*b*. Distributor 28 is operated manually. It is a two-position distributor. It connects supply main 37 with cylinder 32 of unit 1 through pipe 53. From distributor 28 a pipe supplies the medium to the lining for the purpose of its relaying, as well as pipe 50 connected with flow-off main 51 through non-return valve 36. Pipe 50 is connected with pipe 52 which drains leakages from distributor 27. The manually operated two-position distributor 29 is connected at one side to supply main 37 and at the other side it is provided with a pipe through which the medium is supplied to the lining for the purpose of withdrawing, as well as with pipe 49. One branch of pipe 49 is connected with the under-piston chamber of cylinder 32, whereas the other branch of the said pipe is connected with the over-piston chamber of cylinder 32. Distributor 29 either connects or separates the branches of pipe 49. The over-piston chamber of cylinder 32 is connected with supply main 37 by means of pipe 39 provided with non-return valve 34 and gland 33.

Cylinder 32 of the upper pressure unit 1, 1*a*, 1*b* is provided with internal annular recesses 41, 43, 45 and 47 spaced in relation to one another by the depth of one web of the plough. Recess 41 is situated at the same distance from the bottom of cylinder 32. Recesses 41 and 45 are connected with distributor 27*a* by means of pipes 42 and 46, whereas recesses 43 and 47 are connected with distributor 27*b* by means of pipes 44 and 48. Distributors 27*a*, 27 and 27*b* are connected with flow-off main 51.

At the start of operation of the device for mining of thick strata, piston rod 31 is pushed into cylinder 32 to its full depth. At that time distributor 29 occupies position I, i.e. the over-piston and the under-piston chambers of cylinder 32 are not connected with each other by means of pipe 49. Simultaneously, distributor 28 occupies position I and connects the under-piston chamber of cylinder 32 with supply main 37. Pressure under the piston is that of supply source 30. Distributor 27*a* occupies also position I, so that annular recesses 41, 43, 45 and 47 are not connected with flow-off main 51. At that time distributor 27*b* occupies position II. Thus pipes 44 and 48 are closed. Pressure in the over-piston chamber of cylinder 32 is high and results from the pressure in the under-piston chamber connected with supply source 30.

At that time plough 10 is in the region of distributor 27 and advances towards distributor 27*a*. At the moment when plough 10 pushes, with its slide 9, the lever 8*a* of distributor 27*a*, the plough is moved to position II and remains in this position, in spite of the fact that after the slide 9 passes, lever 8 returns to the central position. At the moment when distributor 27*a* occupies position II, annular recess 41 of cylinder 32 is connected by means of pipe 42 with flow-off main 51. Pressure in the over-piston chamber of cylinder 32 drops, and pressure in the under-piston chamber of cylinder 32, which is connected by means of pipe 53 and distributor 28 with supply source 30, makes the piston rod 31 advance out of the cylinder 32. The advancing piston rod 31 moves guide 2 towards the face of the longwall. Piston rod 31 advances until annular recess 41 is covered by the piston. Then the over-piston chamber of cylinder 32 is closed again. Thus, an equilibrium of forces acting upon piston rod 31 is established and piston rod 31 stops moving towards the longwall face. Since the distance between the bottom of cylinder 32 and annular recess 41 is appropriately matched, piston rod 31 protrudes by one web of plough 10.

When returning, plough 10 passes distributor 27*a* and deflects lever 8*a*, thus moving the slide of distributor 27*a* to position III. Pipe 42 is closed, whereas pipe 46 still remains closed. Then, one of the pipes connected with distributor 27*a* is connected with flow-off main 51, but this does not affect the upper pressure unit 1. In its further travel, plough 10—by means of slide 9—deflects lever 8*b* of distributor 27*b*, moving it to position III. Thus, pipe 44 and then annular recess 43 are connected with flow-off main 51. Pressure in the over-piston chamber of cylinder 32 drops and piston rod 31 under the effect of pressure in the under-piston chamber of cylinder 32 shifts guide 2 twoards the longwall face, since the under-piston chamber is connected by means of pipe 53 through distributor 28 with supply main 37 wherein the pressure is that of supply source 30. Piston rod 31 moves until the moment when the piston covers annular recess 43 and a state of equilibrium is attained in the cylinder.

After the plough 10 passes by distributor 27*a* four times, its slide is shifted again to position I during withdrawing of a section of lining 6 by means of pressure provided by pipe 52.

When piston rod 31 protrudes completely from cylinder 32, relaying of the lining is carried out. Distributor 29 is shifted manually to position II. Props of the lining are connected through supply main 37 with supply source 30. The lining is withdrawn. At the same time, the over-piston chamber and under-piston chamber of cylinder 32 are connected with each other by means of pipe 49, and—by means of pipe 48 and distributor 27*b*—with flow-off main 51 and tank 30. Piston rod 31 can move freely in cylinder 32. Consequently, unit 1 can deflect freely in a vertical plane, due to the withdrawing of canopy 5 and relaying of the lining. Relaying of the lining is carried out by means of manual shifting of distributor 28 to position II. The under-piston chamber of cylinder 32 is connected with tank 35 by means of pipe 53, distributor 28, pipe 50, and non-return valve 36.

At the same time, lower ram 21 is appropriately connected (for relaying of the lining) to supply main 37 and supply source 30 through distributor 28. The lining is moved towards conveyor 19, together with cylinder 32, and consequently, piston rod 31 is pushed into cylinder 32, and the device is prepared for a new cycle of operation.

When the upper pressure unit 1 is in operation, lower ram 21 constantly presses slidable system 26 against conveyor 19 which—by means of guide 22—presses the lower part of plough 10 against the longwall face. Plough 10 is provided with a lower drive for advance by means of chain 20 situated in guide 22.

What is claimed is:

1. In a device for mining thick strata of useful minerals, comprising a section of wall lining, a mining machine including a plough, conveyor means for removal of mined minerals, pressing means for urging said mining machine against the face of the strata being mined at first and second points, the first point being in the region of the floor and the second point being above the level of the reaction force of the rock being mined against the mining machine, said pressure means comprising rams extending substantially parallel to the floor and comprising an upper pressure unit fixed to a canopy of the lining, said unit including a piston rod with a guide connected with play with guides of the neighboring sections of the lining to form one sequence, said mining machine including a slide which is slidable in a vertical plane and slides on a guide, the improvement comprising a cylinder for the upper pressure unit provided with annular recesses, every second recess being connected to a first multi-position distributor fixed to another section of the lining and connecting said cylinder to a flow-off main, every other second annular recess being connected with a second multi-position distributor fixed to another section of the lining opposite to said first distributor, said second distributor being connected to said flow-off main, said cylinder having a piston therein dividing the cylinder into two chambers, one of said chambers being connected to a supply main, said distributors all including respective levers situated within the region of movement of said plough so that said levers are deflected by said plough from respective neutral positions, and return to the neutral positions after passage of said plough, said distributors including respective slides which remain in the position to which it has been shifted.

2. A device according to claim 1, wherein each of said distributors is a five-position, four-way distributor whose first position closes all four ways, and each next position opens only one way.

3. A device according to claim 2 comprising a pipe connecting said chambers of said cylinder through a manually operated distributor which in one position serves for withdrawal of said lining.

4. A device according to claim 3 comprising a second pipe connecting said cylinder of the upper pressing unit with said supply main, a manually operated distributor in said second pipe which, after re-positioning, connects said cylinder to said flow-off main, whereas in the same position it connects the lower hydraulic ram with said supply main in the direction of relaying of the lining.

5. A device according to claim 4 comprising a clamping ring fixed to said canopy and enclosing said upper pressure unit.

6. A device according to claim 5 comprising a third pipe having a non-return valve with a gland connecting the upper chamber of said cylinder to said supply main.

7. A device according to claim 6 comprising a chain mounted in the guides of the upper pressure unit and fixed to the plough by a slide.

* * * * *

UNITED STATES PATENT AND TRADEMARK OFFICE

CERTIFICATE OF CORRECTION

PATENT NO. : 4,240,666

DATED : December 23, 1980

INVENTOR(S) : PODGORSKI ET AL

It is certified that error appears in the above-identified patent and that said Letters Patent are hereby corrected as shown below:

On The Title Page:

Amend priority date of parent Polish application to read --April 14, 1978--

Signed and Sealed this

*Ninth* Day of *June 1981*

[SEAL]

*Attest:*

RENE D. TEGTMEYER

*Attesting Officer*

*Acting Commissioner of Patents and Trademarks*